United States Patent [19]

Regan

[11] Patent Number: 4,476,934

[45] Date of Patent: Oct. 16, 1984

[54] RETRACTABLE STINGER PURGE VALVE

[75] Inventor: Albert M. Regan, Huntington Beach, Calif.

[73] Assignee: Hughes Tool Company, Houston, Tex.

[21] Appl. No.: 527,927

[22] Filed: Aug. 30, 1983

[51] Int. Cl.[3] ..... E21B 34/04

[52] U.S. Cl. ..... 166/368; 166/87

[58] Field of Search ..... 166/368, 72, 86–89, 166/95, 97, 316, 90, 344, 345, 365, 386, 321; 137/597; 251/63, 349, 353

[56] References Cited

U.S. PATENT DOCUMENTS 4,109,712 8/1978 Regan ..... 166/87 X 4,333,526 6/1982 Watkins et al. ..... 166/87

*Primary Examiner*—James A. Leppink

*Assistant Examiner*—Thuy M. Bui

*Attorney, Agent, or Firm*—Robert A. Felsman; James E. Bradley

[57] ABSTRACT

A subsea well assembly has features that allow a riser string leading to the surface to be purged of well fluids prior to pulling the riser string. The well assembly includes a riser connector that seats on a Christmas tree. The Christmas tree and connector have coaxial bores, the ends of which are separated from each by a chamber. A stinger interconnects the bores and extends through the chamber. The stinger has upper and lower pressure shoulders. Hydraulic fluid pressure applied to the lower shoulder causes the stinger to retract from the Christmas tree bore. This allows communication of the connector bore with an annulus passage also located in the connector bore. Fluid can then be pumped down the annulus passage to flow through the chamber and return up the connector bore, purging the riser of well fluid.

3 Claims, 2 Drawing Figures

RETRACTABLE STINGER PURGE VALVE

BACKGROUND OF THE INVENTION

1. Field of the Invention

This invention relates in general to subsea oilwell installations, and in particular to a means for purging a completion workover riser string of oil preparatory to pulling the riser string.

2. Description of the Prior Art

In general, a subsea well assembly has a Christmas tree mounted on a wellhead. The wellhead comprises the upper end of casing which has been cemented in the well. A tubing hanger is mounted in the wellhead, with the oil being produced through the tubing normally. At times the operator may need to pump stimulating or cleaning fluids into the well or perform wireline operations to increase production. During completion and workover operations, the operator removes the cap to the Christmas tree and lowers a workover riser string from a workover vessel to the Christmas tree. The riser string has a central passage for pumping fluids down and also has an annulus passage which is in communication with an annulus passage in the Christmas tree. The annulus passage in the Christmas tree communicates with the annulus between the tubing and the casing in the well.

When completion or workover operations are taking place, the riser string production passage may be filled with reservoir fluid or treating chemicals. To avoid polluting the sea when pulling the riser string, a purge valve is mounted externally above the Christmas tree. This purge valve will enable fresh water to be circulated up the production passage of the string, purging the string of pollutants. While this system achieves the desired results, external purge valves are difficult to mount, adversely affect the balance of the completion workover package and expensive.

SUMMARY OF THE INVENTION

In this invention, purging of the riser string is accomplished by using a retractable stinger. The stinger is a tube that extends between a production bore in the workover connector into the production bore of the Christmas tree. The stinger has upper and lower pressure shoulders. Hydraulic ports extend through the workover connector above and below the pressure shoulders. Applying hydraulic pressure causes the stinger to move upward. When the stinger moves upward, its lower end disengages from the Christmas tree. A chamber exists between the Christmas tree bore and the wellhead bore, and this chamber then serves as a communication link between the workover connector annulus passage and the connector production bore. Fresh water can then be pumped down the workover riser annulus passage to return up the production passage, or can be pumped down the production passage to return up the riser annulus passage.

The passage can be closed by reversing the hydraulic pressure. The diameters and areas of the pressure shoulders can be sized so that in the event of hydraulic control failure the stinger can be raised by applying pressure to the annulus passage.

DESCRIPTION OF THE PREFERRED EMBODIMENT

Figure 1:
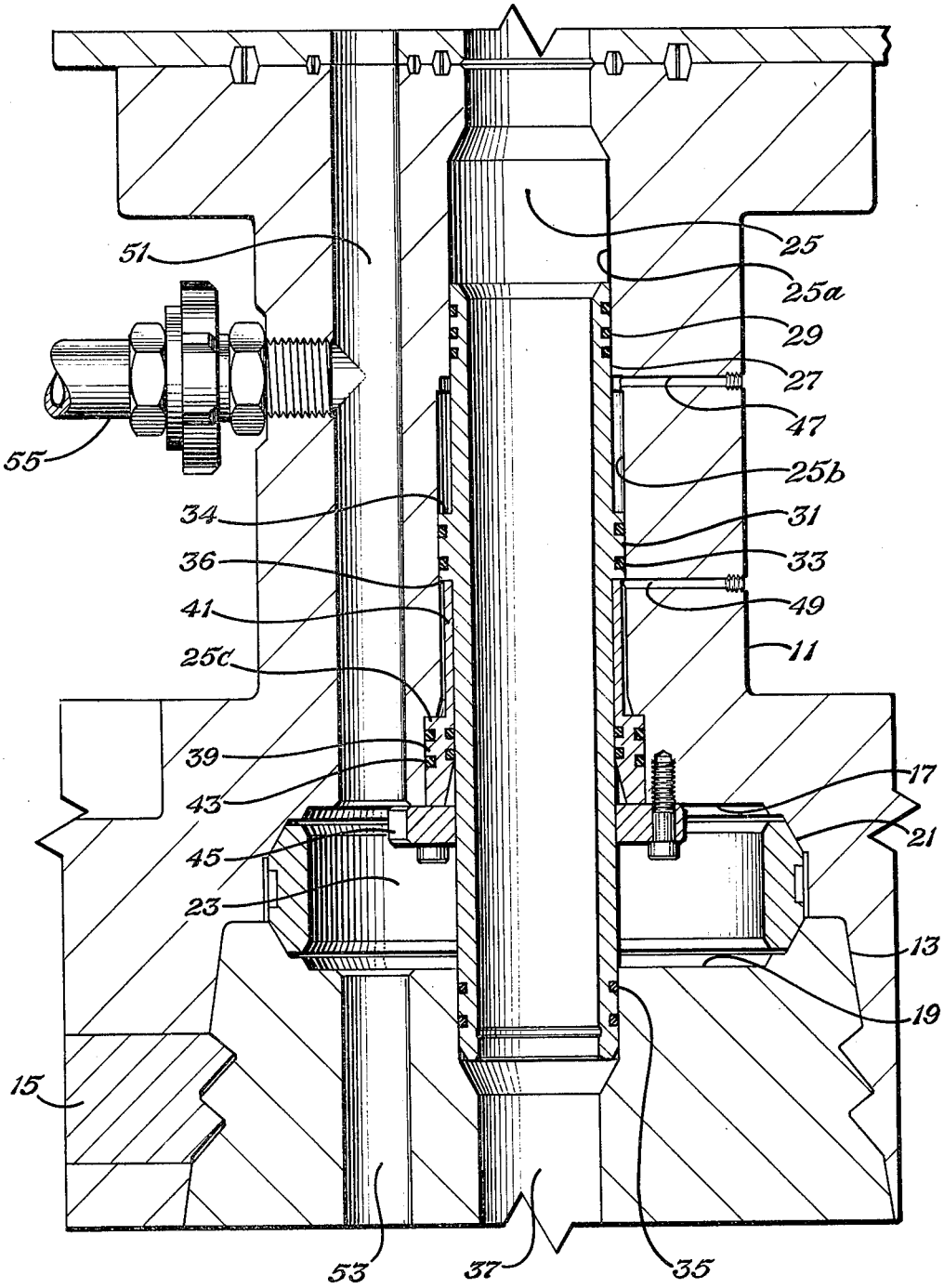
FIG. 1 is a sectional view illustrating portions of a Christmas tree and workover connector having a retractable stinger constructed in accordance with this invention.

Referring to FIG. 1, workover connector 11 is a generally tubular structure that is sealingly mounted to a Christmas tree 13 when workover operations are needed. The workover connector 11 is mounted to the lower end of a string of riser pipe (not shown) lowered from a workover vessel. A locking ring 15 secures the workover connector 11 to the Christmas tree 13 which has its cap (not shown) removed.

Workover connector 11 has a lower face 17 that is located above an upper face 19 of the Christmas tree 13. A metal seal ring 21 is mounted between these faces, defining a chamber 23. Casing (not shown) is mounted below Christmas tree 13 and is cemented in the well. A tubing hanger (not shown) of conventional design is also mounted below Christmas tree 13 for supporting a string of tubing within the casing for producing well fluid in a conventional manner.

Workover connector 11 has a production bore 25 that has an upper section **25*a*. A large diameter intermediate section 25*b* is located immediately below. An even larger diameter lower section 25*c* forms the lower end of the bore 25, which extends to the lower face 17**.

A stinger 27 is reciprocally and sealingly mounted inside the workover connector bore 25. Stinger 27 has on its upper end seals 29 that sealingly engage the section **25*a*. An annular band 31 is located in an intermediate section of stinger 27. Band 31 protrudes radially outward from the wall surface of stinger 27 and engages the intermediate section 25*b*. Seals 33 seal the annular band 31 to the bore section 25*b*. The sliding seal engagement of band 31 results in an upper pressure shoulder 34 and a lower pressure shoulder 36**.

The stinger 27 extends downwardly through the chamber 23 and reciprocally engages a Christmas tree bore 37. Bore 37 is coaxially with the workover connector bore 25. Seals 35 on the lower end of stinger 27 provide sealing engagement. Stinger 27 is carried within bore 25 by a retaining sleeve 39. Retaining sleeve 39 has a reduced diameter neck 41 that extends upwardly in the bore section **25*b*. A clearance exists between the outer diameter of neck 41 and the bore section 25*b*. Neck 41 is connected to a larger section of retaining sleeve 39 that is sealingly mounted in the lower bore section 25*c* by inner and outer seals 43. A retaining plate 45 is bolted to the lower face 17 for retaining the retaining sleeve 39 rigidly within the bore 25**.

An upper hydraulic port 47 extends from the exterior of workover connector 11 to the upper end of the intermediate bore section **25*b*. This port is connected to hydraulic pressure lines (not shown) for delivering hydraulic fluid under pressure. A lower hydraulic port 49 extends from the exterior of workover connector 11 to the intermediate bore section 25*b*, about halfway along its length. The lower hydraulic port 49 is positioned at the top of fixed retaining sleeve 39 and will always be below the lower pressure shoulder 36 of the stinger 27**.

Workover connector 11 has an annulus passage 51 that is offset from the production bore 25. Annulus passage 51 terminates at the lower face 17 and communicates with an annulus passage 53 in the Christmas tree 13 by means of chamber 23. Annulus passage 51 is connected at its upper end to a passage in the riser string (not shown) that leads to the surface and is separate from a production passage (not shown) through which workover fluids are pumped into the well. A line 55 is connected to annulus passage 51 for monitoring pressure.

In operation, during workover operations, the stinger 27 will be in the lower or flow-through position shown in FIG. 1. The hollow bore of the stinger 27 provides a means for communicating workover fluids pumped down the bore 25 with the Christmas tree bore 37.

Figure 2:
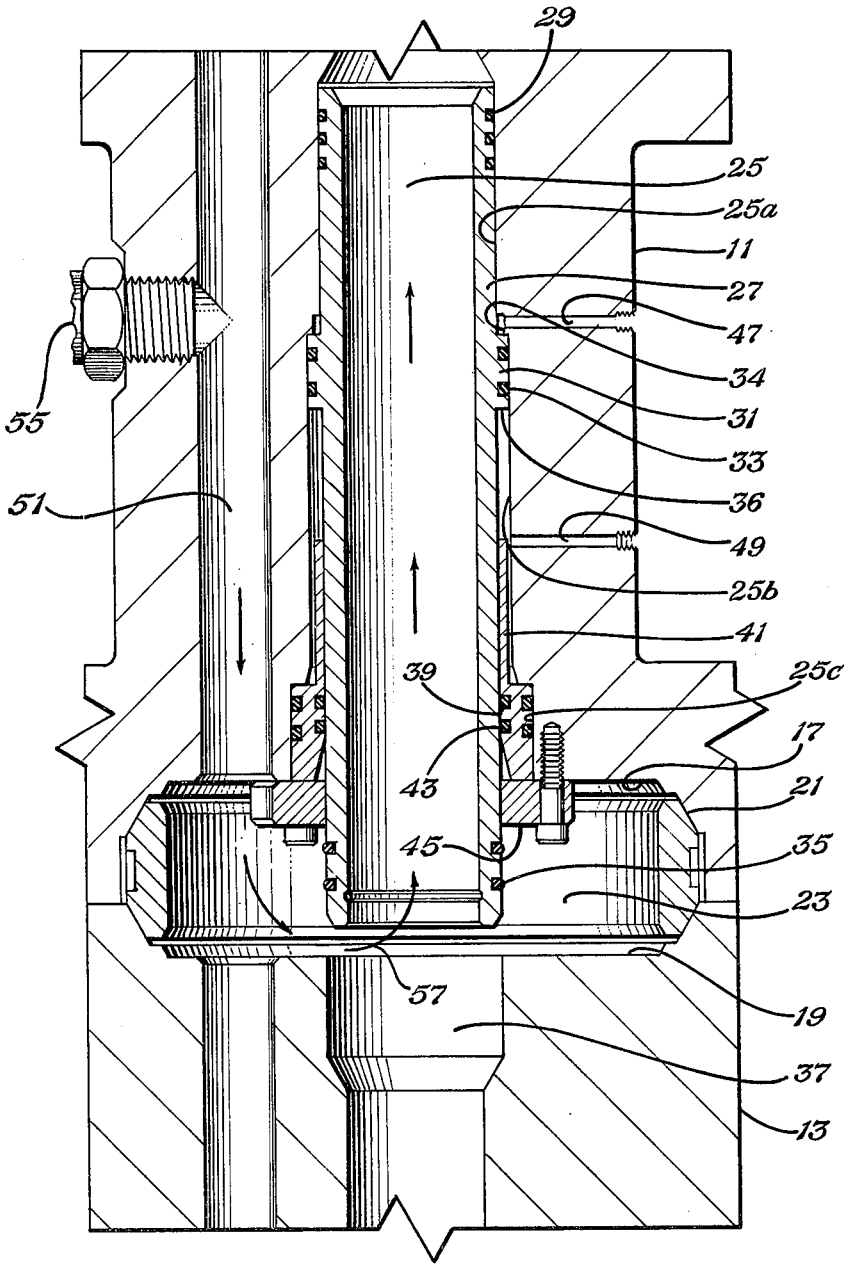
FIG. 2 is a view of portions of the workover connector and Christmas tree of FIG. 1, with the stinger shown in the up or purge position.

When it is desired to purge the riser string (not shown), hydraulic fluid is provided to the lower port 49. The hydraulic fluid acts on the lower pressure shoulder 36, causing the stinger 27 to move upwardly to the position shown in FIG. 2. The reduced diameter section **25*a* limits the upward travel of stinger 27. Valves (not shown) are actuated to close passages 37 and 53 from the well. Fresh water can then be pumped down the riser annulus passage 51, to flow up the workover connector bore 25. The fluid flows through the chamber 23 and back up the riser production passage as indicated by the arrows 57**. At the surface, the fluid being circulated can be stored to avoid pollution. This purges the production passage of the riser of well fluids, allowing the riser to be pulled in sections after completion of the workover.

If it is necessary to pump fluids again through the Christmas tree bore 37 after purging of passage 25, the stinger 27 can be moved back to the flow-through position shown in FIG. 1. This is accomplished by providing hydraulic fluid pressure to port 47. Retaining sleeve 39 limits the length of the downward movement.

The invention has significant advantages. In making the stinger retractable, the stinger can serve not only to communicate the workover connector with the Christmas tree bore, but can also serve as a valve to allow purging of the riser string. This eliminates the need for an external purge valve.

While the invention has been shown in only one of its forms, it should be apparent to those skilled in the art that it is not so limited but is susceptable to various changes without departing from the scope of the invention.

We claim:

1. In a subsea well assembly having a riser connector and means for mounting the connector to a Christmas tree, both of which have bores coaxial with each other, the upper end of the Christmas tree bore being separated from the lower end of the connector bore by a chamber, the connector having an annulus passage that also communicates with the chamber, the improvement comprising:

a stinger having a tubular body with an upper end adapted to engage the connector bore in sliding sealing contact, and a lower end adapted to engage the Christmas tree bore in sliding sealing contact; and means for axially moving the stinger with respect to the connector and the Christmas tree between a flow-through position in which each end engages its respective bore, to a purge position in which one of the ends is withdrawn from its respective bore to allow fluid to be pumped through the annulus passage, chamber and connector bore.

2. In the subsea well workover assembly having a workover riser connector and means for mounting the connector to a Christmas tree, both of which have bores coaxial with each other, the upper end of the Christmas tree bore being separated from the lower end of the connector bore by a chamber, the connector having an annulus passage that also communicates with the chamber, the improvement comprising:

a stinger having a tubular body with an upper end reciprocally and sealingly carried in the connector bore and a lower end adapted to sealingly engage the Christmas tree bore; and hydraulic means for moving with hydraulic fluid pressure the stinger between a flow-through position in which each end engages its respective bore to a purge position in which the stinger's lower end is spaced above the Christmas tree bore, allowing fluid to be pumped down the annulus passage through the chamber and up the connector bore.

3. In a subsea well workover assembly having a workover riser connector and means for mounting the connector to a Christmas tree, both of which have bores coaxial with each other, the upper end of the Christmas tree bore being separated from the lower end of the connector bore by a sealed chamber located between the connector and the Christmas tree, the connector having an annulus passage offset from the connector bore that communicates with the chamber, the improvement comprising:

a stinger having a tubular body with an upper end having annular seals and closely received within the connector bore in an upper section, the stinger having an annular protruding band containing annular seals and closely received within a larger diameter section of the connector bore, the band defining upper and lower pressure shoulders;

a retaining sleeve rigidly secured to the connector bore, located in the larger diameter section of the connector bore and closely receiving the stinger below the band;

seal means for sealing between the stinger and the sleeve;

the stinger having a lower end with annular seals that is adapted to be closely received within the Christmas tree bore;

an upper hydraulic port means extending to the larger diameter section of the connector bore above the band for supplying hydraulic fluid to act downwardly on the upper pressure shoulder to move the stinger downwardly; and a lower hydraulic port means extending to the larger diameter section of the connector bore below the band for supplying hydraulic fluid to act upwardly on the lower pressure shoulder, to cause the lower end of the stinger to disengage from the Christmas tree bore to allow fluid to be pumped down the annulus passage and flow through the chamber to return up the connector bore.

* * * * *